US009353520B2

(12) United States Patent
Antal

(10) Patent No.: US 9,353,520 B2
(45) Date of Patent: May 31, 2016

(54) ENERGY AND WEIGHT EFFICIENT BUILDING BLOCK, MANUFACTURING AND APPLICATION PROCESS THEREOF

(75) Inventor: István Antal, Szeged (HU)

(73) Assignee: WYW BLOCK AG (LI)

( * ) Notice: Subject to any disclaimer, the term of this patent is extended or adjusted under 35 U.S.C. 154(b) by 10 days.

(21) Appl. No.: 13/579,814

(22) PCT Filed: Feb. 15, 2011

(86) PCT No.: PCT/CH2011/000028

§ 371 (c)(1),
(2), (4) Date: Aug. 17, 2012

(87) PCT Pub. No.: WO2011/100854

PCT Pub. Date: Aug. 25, 2011

(65) Prior Publication Data

US 2012/0311953 A1 Dec. 13, 2012

(30) Foreign Application Priority Data

Feb. 17, 2010 (HU) ..... 1000094

(51) Int. Cl.

| | |
|---|---|
| ***E04C 1/40*** | (2006.01) |
| ***E04C 1/41*** | (2006.01) |
| ***E04C 2/296*** | (2006.01) |

(Continued)

(52) U.S. Cl.

CPC ... *E04B 2/16* (2013.01); *E04C 1/40* (2013.01); *E04B 2002/0208* (2013.01); *E04B 2002/0215* (2013.01); *E04C 1/41* (2013.01)

(58) Field of Classification Search

CPC ..... E04C 1/41; E04C 1/40; E04C 2/044; E04C 2/049; E04C 2/2885; E04C 2/284; E04C 2/296; E04C 1/00; E04C 2/288

USPC ..... 52/405.1, 405.2, 405.4, 405.3, 404.4, 52/404.5, 404.3, 442, 309.17, 309.15

See application file for complete search history.

(56) References Cited

U.S. PATENT DOCUMENTS

| | | | | |
|---|---|---|---|---|
| 3,204,381 A * | 9/1965 | Perreton | ..... | 52/309.12 |
| 3,394,517 A * | 7/1968 | Caterina | ..... | 52/436 |
| 3,885,363 A * | 5/1975 | Whittey | ..... | 52/125.3 |

(Continued)

FOREIGN PATENT DOCUMENTS

| | | |
|---|---|---|
| CN | 201003216 Y | 1/2008 |
| CN | 201137225 | 10/2008 |

(Continued)

*Primary Examiner* — Phi A

(74) *Attorney, Agent, or Firm* — Morriss O'Bryant Compagni, PC

(57) ABSTRACT

The subject matter of the invention is an energy and weight efficient building block that has a prismatic body made from a post-hardening material (1). The invention is characterized in that a flexible static insert structure (2) is placed inside the body. Furthermore, the subject matter of the invention is the manufacturing and application process for the production of the building block. Manufacturing is characterized in that a static insert structure (2) is placed into the form body (16), then the form body (16) is filled up with the stirred post-hardening material (1) or at first the stirred post-hardening material (1) is poured into the form body (16), and the static insert structure (2) is placed therein afterwards, then the building block with the static insert structure (2), embedded in the post-hardening material (1) is let to dry until set in the form body (16) itself or after being taken out thereof.

20 Claims, 8 Drawing Sheets

(51) Int. Cl.
*E04B 2/16* (2006.01)
*E04B 2/02* (2006.01)

(56) References Cited

U.S. PATENT DOCUMENTS

| | | | | | |
|---|---|---|---|---|---|
| 4,367,615 | A | | 1/1983 | Feldman | |
| 4,498,266 | A | * | 2/1985 | Perreton | 52/405.4 |
| 4,748,782 | A | * | 6/1988 | Johnson et al. | 52/405.4 |
| 4,769,964 | A | * | 9/1988 | Johnson et al. | 52/405.4 |
| 4,833,852 | A | * | 5/1989 | West | 52/405.1 |
| 6,722,094 | B1 | * | 4/2004 | Judd et al. | 52/404.1 |
| D689,625 | S | * | 9/2013 | Antal | D25/113 |
| 8,549,808 | B2 | * | 10/2013 | Badin | 52/405.4 |
| 2004/0040240 | A1 | * | 3/2004 | Patz et al. | 52/309.11 |
| 2006/0248847 | A1 | | 11/2006 | Simon | |
| 2007/0294970 | A1 | * | 12/2007 | Marshall et al. | 52/309.11 |
| 2008/0060300 | A1 | * | 3/2008 | Westmoreland et al. | 52/405.4 |
| 2009/0013629 | A1 | * | 1/2009 | Boeshart | 52/426 |
| 2009/0308011 | A1 | * | 12/2009 | Philippe | 52/426 |
| 2012/0060438 | A1 | * | 3/2012 | Jensen | 52/438 |

FOREIGN PATENT DOCUMENTS

| | | | | | |
|---|---|---|---|---|---|
| CN | 201241475 | Y | | 5/2009 | |
| DE | 3319645 | | | 12/1984 | |
| DE | 19506065 | | | 8/1996 | |
| DE | 19714626 | | | 10/1997 | |
| DE | 19848534 | A1 | | 4/2000 | |
| DE | 102005017643 | | | 10/2006 | |
| DE | 102007014366 | A1 | | 2/2008 | |
| FR | 2934617 | | * | 5/2010 | E04C 1/41 |
| GB | 1498383 | | | 1/1978 | |
| HU | 223387 | | | 6/2004 | |
| JP | 42-009962 | Y | | 5/1967 | |
| JP | 48-002224 | U | | 1/1973 | |
| JP | 59-048553 | A | | 3/1984 | |
| JP | 03-046390 | B | | 7/1991 | |
| JP | 2001-316159 | A | | 11/2001 | |
| KR | 1019950001912 | B | | 3/1995 | |
| WO | 2008085976 | A2 | | 7/2008 | |

* cited by examiner

ENERGY AND WEIGHT EFFICIENT BUILDING BLOCK, MANUFACTURING AND APPLICATION PROCESS THEREOF

CROSS-REFERENCE TO RELATED APPLICATIONS

This application is a national phase entry under 35 U.S.C. §371 of PCT/CH2011/000028 filed on Feb. 15, 2011, which claims priority to Hungarian Patent Application P1000094 filed on Feb. 17, 2010, the entirety of each of which are incorporated by this reference.

BACKGROUND

1. Field of the Invention

The subject matter of the invention is an energy and weight efficient building block, manufacturing and application process thereof.

2. State of the Related Art

The solution of the invention may be used in the building industry for the construction of building structures, buildings (detached houses, semi-detached houses, office buildings, educational establishments) with homogenous, solid, lightweight wall structure and good vapour diffusion, excellent fire retardant, heat and sound insulation properties in a relatively short time and in an economical way.

As it is known, several methods have been worked out for the construction of building structures as well as for the production of polystyrene foam concrete.

For example, patent description No. GB1498383 describes a mortar suitable for the construction of lightweight building structures with good heat and sound insulation properties that contains foamed polystyrene, cement and water. The mortar thus produced is suitable for the construction of building blocks either in situ or at the company manufacturing the building material.

The building structure having an inner frame and permanent formwork to support the weight as well as the moulded piece, along with the manufacturing process thereof, set forth in the patent description with registration number HU223387, are of the same technical level. This known solution does not allow the joining of a wall section higher than 3-4 rows because concrete forces apart permanent formwork elements, and it can be surrounded by wall in about 3 days only because technological drying has to be waited for with each operation. Another disadvantage of this solution is that the building structure does not breathe because polystyrene is not air permeable.

The heat-insulated soundproof concrete load-bearing shear wall with steel wire net-cages, which is characterized in that the wall comprises a polystyrene foam board, both sides of which are respectively provided with a steel wire net-cage which forms the wall framework, set forth in patent description No. CN201137225, is of the same technical level. This known solution is deficient in that the steel loses its temper at 400-500° C. and can resist fire for up to 30 minutes since the steel wire net-cage is not protected with a fire retardant material. Another deficiency of this solution is that the use of a steel wire net-cage does not allow the fastening of heavier objects into the wall.

The wall system with insulation properties, made up of building blocks (formwork elements) joined with grooves and tongues of different shape, set forth in patent description No. DE19714626, is of the same technical level. The building blocks may be combined in various ways and used in particular for making walls with concrete core after the filling in of the concrete, leaving the shuttering elements in place. This known solution does not allow the joining of a wall section higher than 3-4 rows either because concrete forces apart permanent formwork elements, furthermore, smoke generation is high according to fire protection rules, therefore it cannot be used for making community buildings (for example, office buildings, educational establishments, hotels). Besides mechanical basic wires can be fastened only to the concrete core, in consequence of which sound insulation of the buildings will not be adequate.

SUMMARY OF THE INVENTION

The wall system The invention aims at eliminating the deficiencies of known solutions and creating an energy and weight efficient building block as well as working out the manufacturing and application process thereof, which enable the construction of building structures, residential and community buildings as well as industrial buildings with homogenous, solid, lightweight wall structure, without a cold bridge and having good vapour diffusion, excellent fire retardant, heat and sound insulation properties in a environmentally friendly way, simply, quickly and economically.

The solution of the invention is based on the recognition that producing a building block made from two kinds of material, namely a lightweight, post-hardening material and a flexible static insert structure, the thermal conductivity (heat technical parameter) of which is the same, furthermore, if the static insert structure is formed in a way that it is flexible for shape changes in directions perpendicular to the loading direction and suitable for damping mechanical vibrations, it achieves the objectives of the energy and weight efficient building block of the invention and the manufacturing process thereof and its application process pertaining to the production of building structures.

BRIEF DESCRIPTION OF THE DRAWINGS

The wall system The solution of the invention is described in detail on the basis of drawings which are the following.

DETAILED DESCRIPTION OF THE ILLUSTRATED EMBODIMENTS

Figure 1:
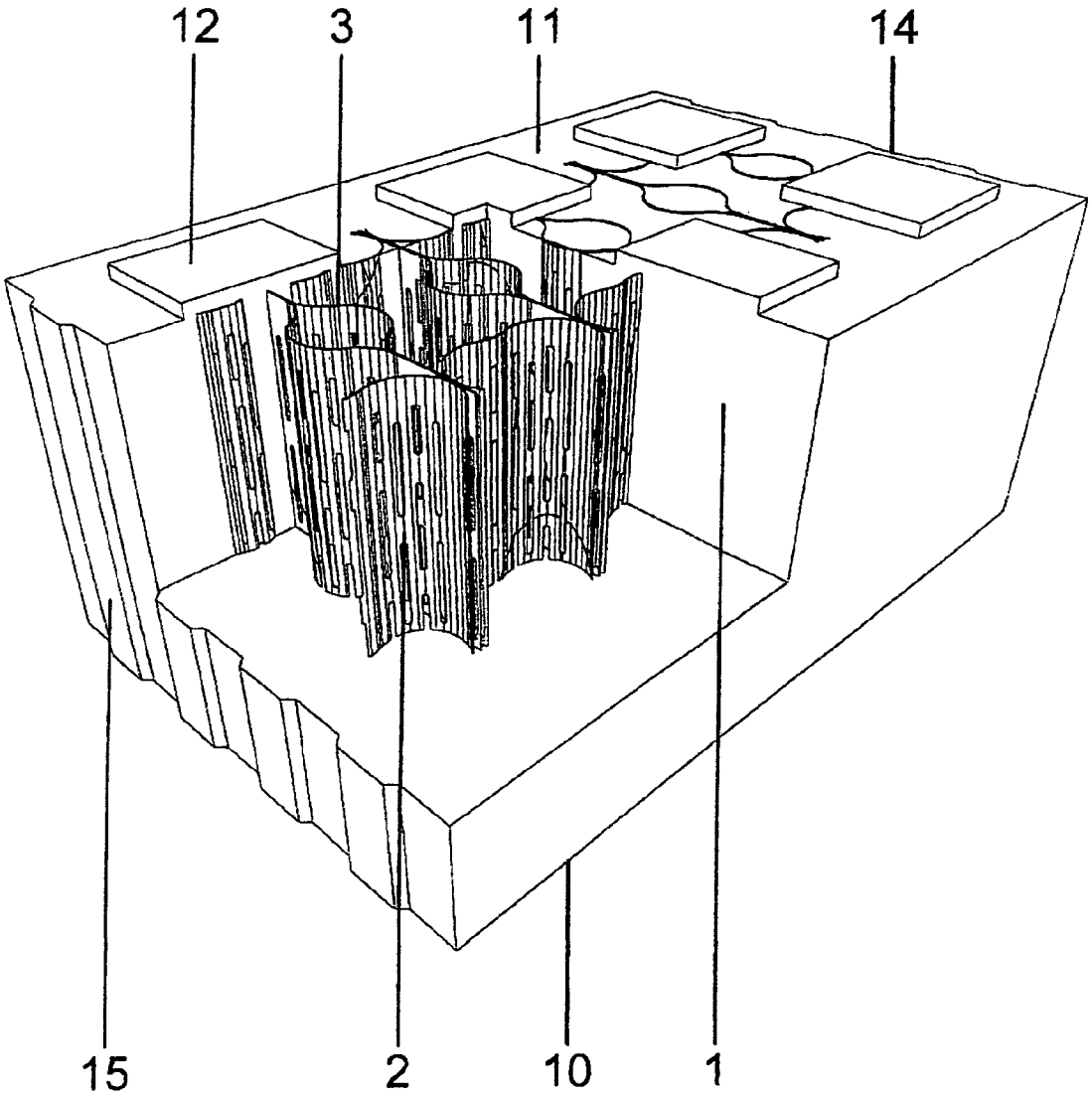
FIG. 1 shows the axonometric exploded view drawing of an embodiment of the building block of the invention.

FIG. 1 shows the axonometric exploded view drawing of an embodiment of the building block of the invention. The building block is depicted as standing on its ground plane 10, and with this embodiment its body is of prism shape, as it is visible in the drawing. The body of the building block is formed from a post-hardening material 1, inside which a flexible static insert structure 2 is placed, which is made of metal. With this embodiment, the static insert structure 2 is assembled from several insert profiles 3 with the same structure. On the upper plane 11 of the building block, protruding from the plane thereof, at nearly the same distance from the edges, positive adapters 12 are formed, which are frustums of pyramids with a square base. On one of the faces of the right rectangular prism, perpendicular to its flat front plane, grooves 14 are formed, whereas on the other face, tongues 15 are formed. In another embodiment, this can be implemented the other way around, too.

Figure 2:
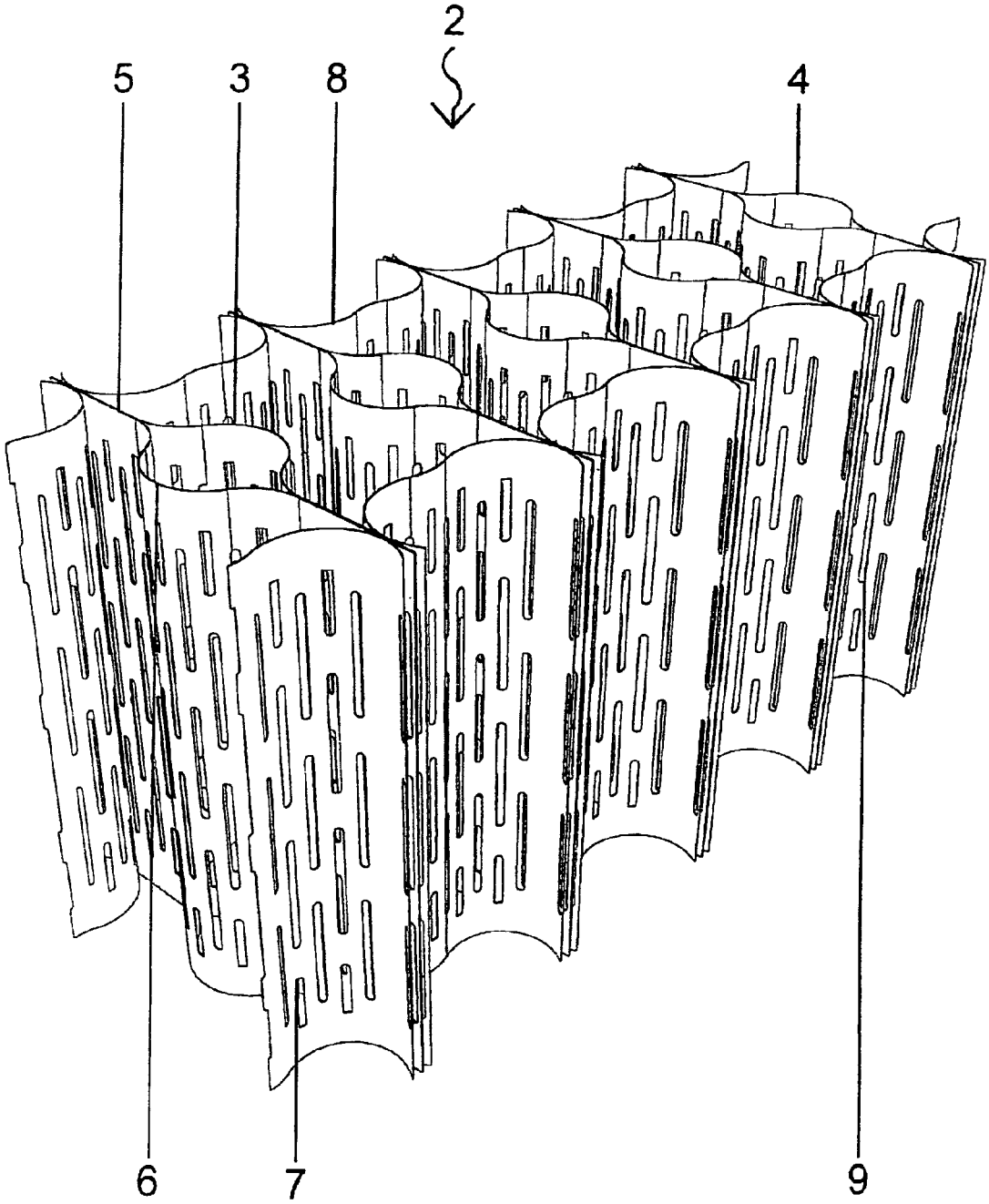
FIG. 2 shows the axonometric drawing of an embodiment of the static insert structure of the invention.

FIG. 2 shows the axonometric drawing of an embodiment of the static insert structure 2 of the invention. In this case, the flexible static insert structure 2 is made of metal, for example of hot-dip galvanized steel 0.25-2 mm thick. The static insert structure 2 is assembled from at least one, or more insert profiles 3 with the same structure. One insert profile 3 can be regarded as a basic unit, which is made from two mirror-symmetric half elements 4, a straight-line part 5 on its two edges, and an arched-line part 6 in its middle third. In case of more than one insert profiles 3, an auxiliary tensioning element 7 is connected to both sides of both edges. Between two insert profiles 3, the auxiliary tensioning element 7 is made from one piece. The straight-line part 5 of the insert profile 3 and the joining auxiliary tensioning elements 7 are together shaped as a cutting edge 8. The cutting edges 8 play an important role at the construction of the building structures, when cutting edges 8 thus formed, in case of placing the building blocks of the invention on each other, cut into the positive adapters 12 at the superposition of negative adapters 13 on positive adapters 12, and actually fasten the static insert structure 2. Thus they increase stability against horizontal pressure (in directions perpendicular to the loading direction), furthermore, they ensure the even static distribution of the cumulative load by way of the coupling of the insert profiles 3 of the static insert structure 2, placed on each other. At the same time, static insert structure 2 will be suitable for damping possible mechanical vibrations due to its flexibility, in consequence of which the possibility of occurrence of cracks in the wall structure of the building structures will be minimized. There are perforations 9 made on the surface of the half elements 4 and the auxiliary tensioning elements 7, which enable an even spread of the post-hardening material 1 in the form body 16, lighten the weight of the building block, as well as make the way of the heat longer, thus increase heat insulation.

Figure 3:
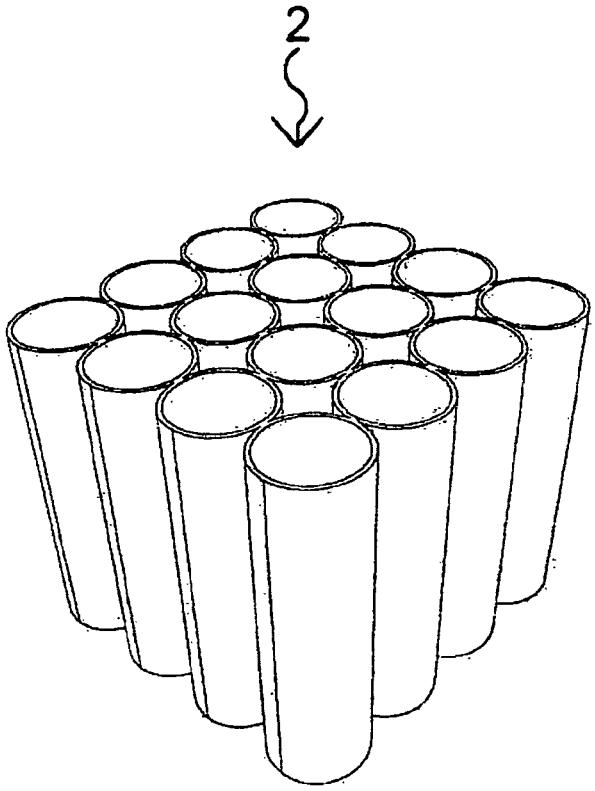
FIG. 3 shows the axonometric drawing of another embodiment of the static insert structure of the invention.

FIG. 3 shows the axonometric drawing of another embodiment of the static insert structure 2 of the invention. With this embodiment, the static insert structure 2 is made from cylindrical plastic tubes, which is also suitable for the even static distribution of the cumulative load due to its flexibility.

Figure 4:
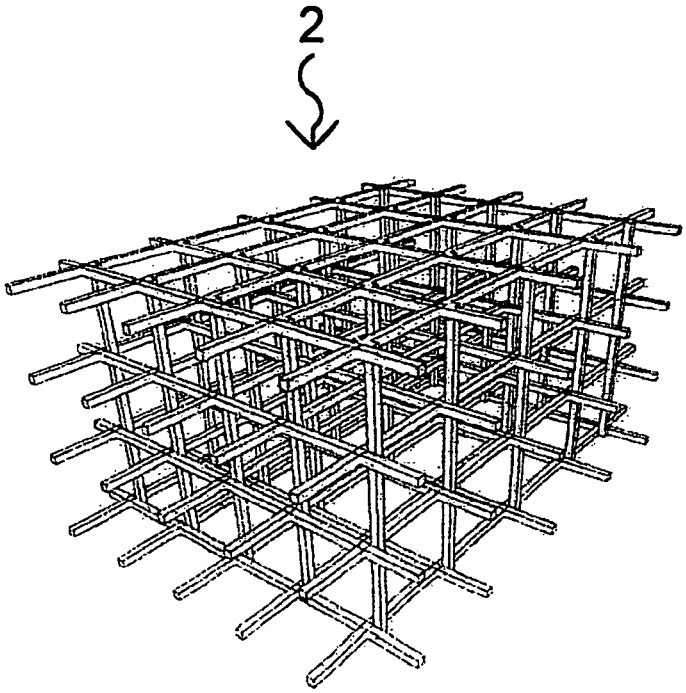
FIG. 4 shows the axonometric drawing of a third embodiment of the static insert structure of the invention.

FIG. 4 shows the axonometric drawing of a third embodiment of the static insert structure 2 of the invention. With this solution, the static insert structure 2 is made from an organic material, such as latticed bamboo, which is also of a flexible material. Besides the organic matter can also be wood or cane.

The building blocks implemented with the static insert structures 2 shown either in FIG. 3 or in FIG. 4 should be used for the construction of buildings in case of which no outstandingly high fire prevention and/or relatively not great static stress has to be ensured, for example, for the construction of two-story buildings at most.

Figure 5:
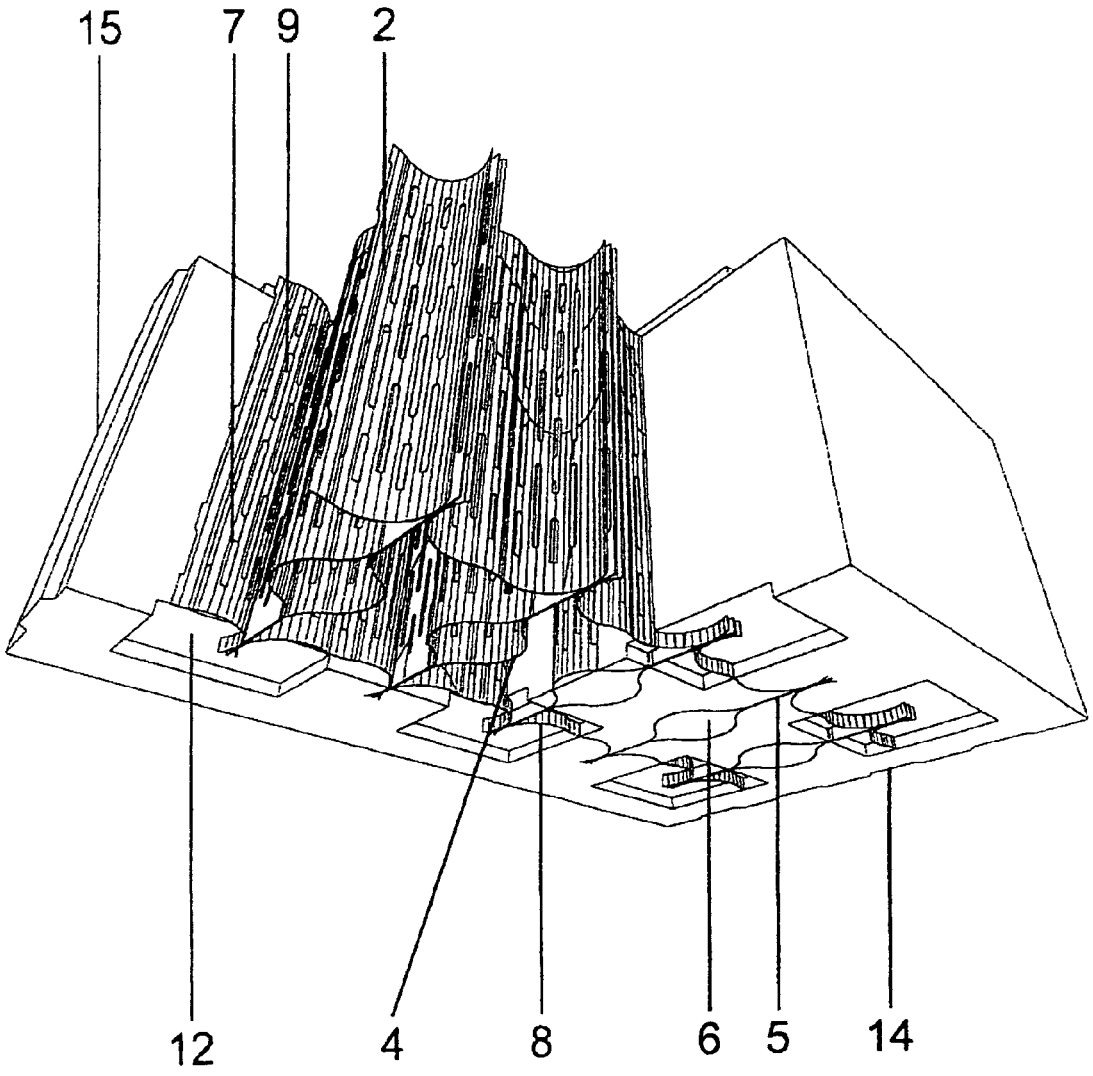
FIG. 5 shows the axonometric exploded view drawing of an embodiment of the building block of the invention, implemented with a static insert structure made of metal.

FIG. 5 shows the axonometric exploded view drawing of an embodiment of the building block of the invention, implemented with a static insert structure 2 made of metal, with special regard to the design of cutting edges 8. Insert profile 3 is made from two mirror-symmetric half elements 4, a straight-line part 5 on its two edges, and an arched-line part 6 in its middle third. Since the static insert structure 2 is assembled from more than one insert profiles 3, an auxiliary tensioning element 7 is connected to both sides of both edges of the insert profile 3. The straight-line part 5 and the joining auxiliary tensioning elements 7 are together shaped as a cutting edge 8, as it can be seen in the drawing. The size of the positive adapters 12 and the distance there between is determined in a way that for example in the case of a static insert structure 2 assembled from five insert profiles 3 three cutting edges 8 cut about into the middle of the positive adapter 12, such as to a depth of 1 cm, because on the basis of practical experience, this cutting depth ensures the best result as regards stability and the even static distribution of the load. The drawing also depicts half elements 4, the perforations 9 made on the surface of the auxiliary tensioning elements 7, the grooves 14 and the tongues 15.

Figure 6:
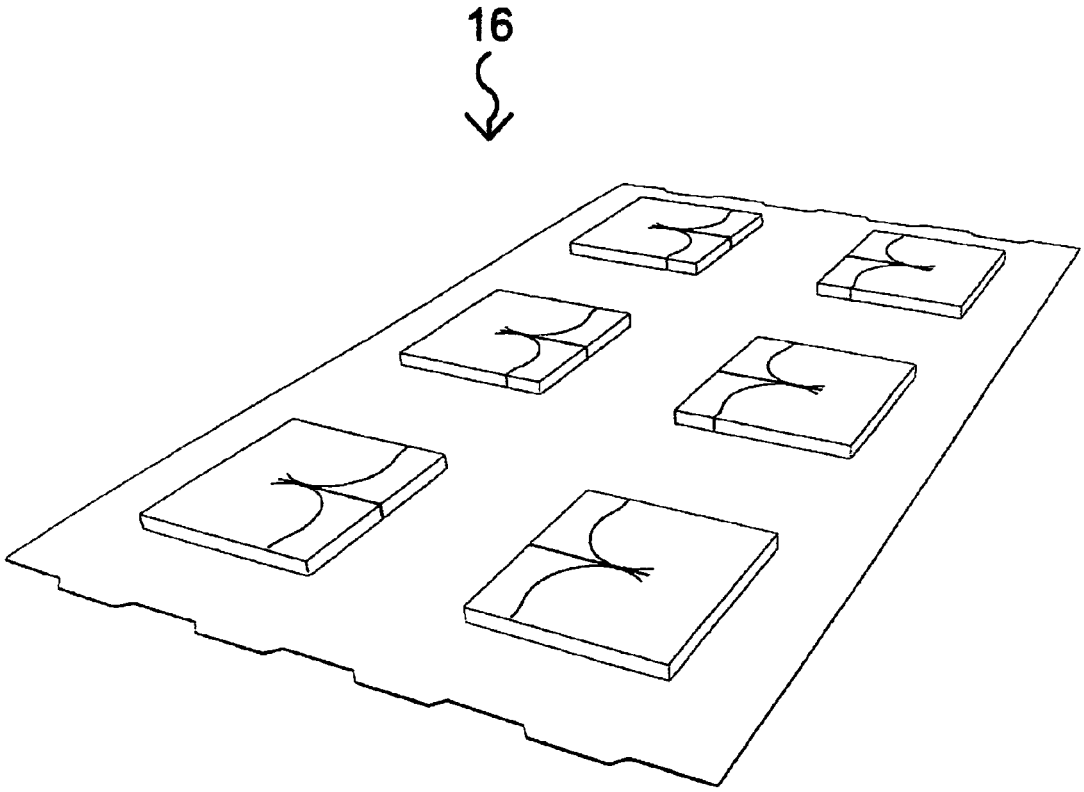
FIG. 6 shows the axonometric drawing of an embodiment of the base face of the form body necessary for the manufacturing of the building block of the invention.

FIG. 6 shows the axonometric drawing of an embodiment of the base face of the form body 16 necessary for the manufacturing of the building block of the invention. Negative adapters 13 are formed on the ground plane of the building block 10, on the base face of the form body 16 in a way that profiles, such as frustum of pyramids with a rectangular base, are formed on the base face, protruding from the plane thereof, in the middle of which the places necessary for the cutting edges 8 are formed, such as by means of milling. As the drawing shows, in case of an embodiment, six companion pieces necessary for the production of six negative adapters 13 are formed on the base face of form body 16.

Figure 7:
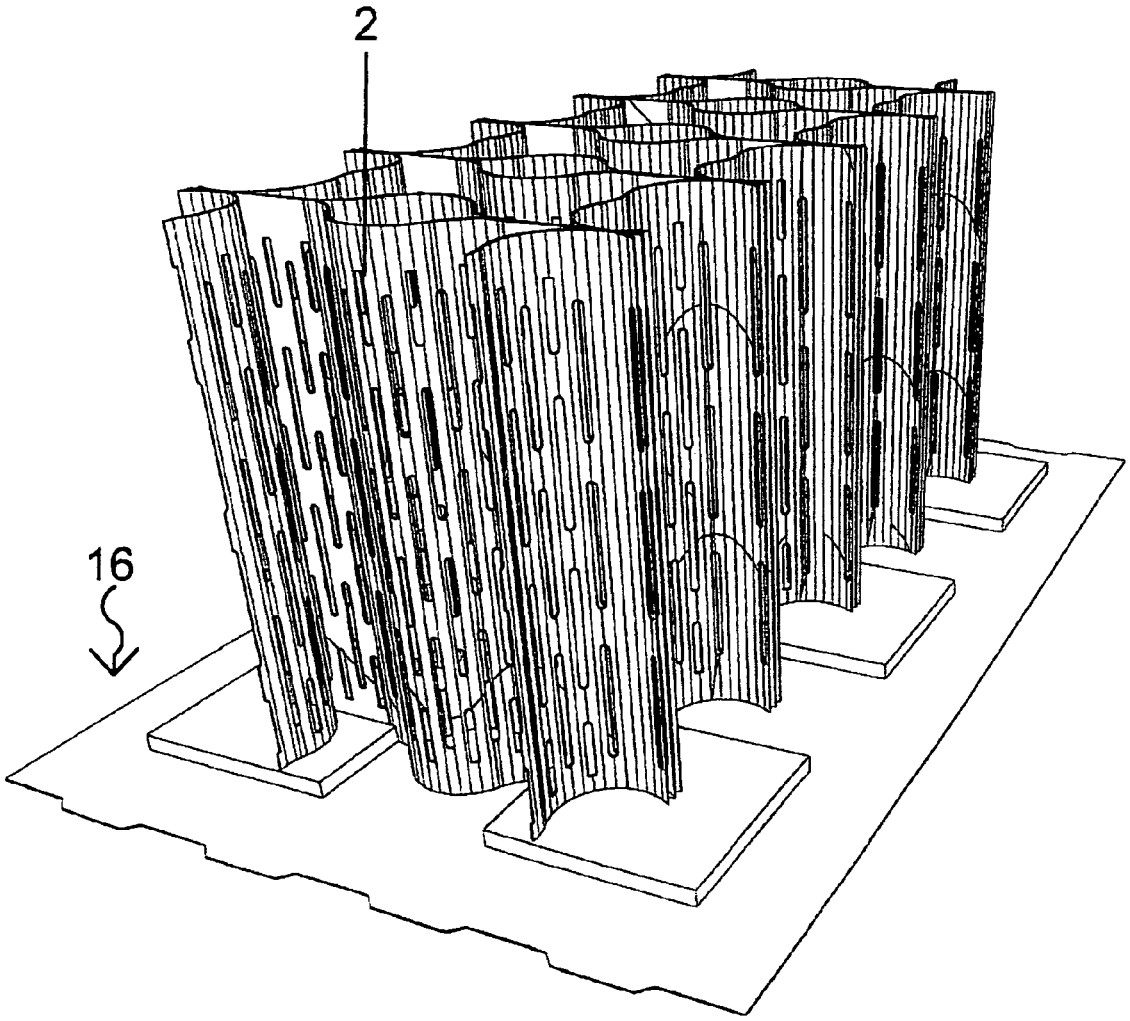
FIG. 7 shows the axonometric drawing of an embodiment of the base face of the form body necessary for the manufacturing of the building block of the invention and of the static insert structure placed thereon.

FIG. 7 shows the axonometric drawing of an embodiment of the base face of the form body 16 necessary for the manufacturing of the building block of the invention and of the static insert structure 2 placed thereon. With this embodiment, in comparison with the previous FIG. 6, the static insert structure 2 is placed in the places milled for the cutting edges 8, which is a further step of the manufacturing process. Both the previous figure and this figure show the companion pieces necessary for the forming of grooves 14 on one face of the form body 16, and for the forming of tongues 15 on the other, and the other way around.

Figure 8:
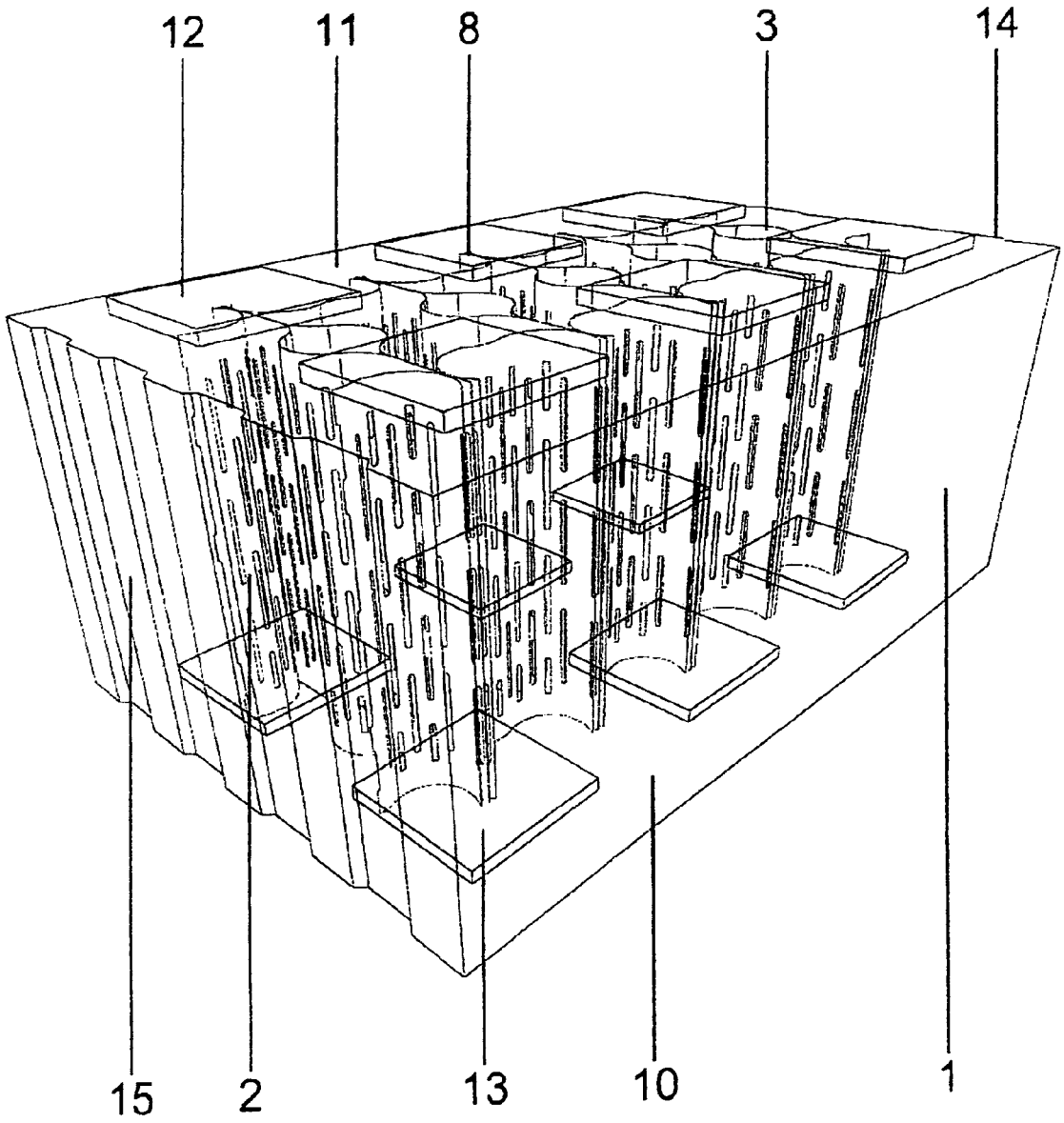
FIG. 8 shows the axonometric drawing of an embodiment of the building block produced according to the manufacturing process of the invention.

FIG. 8 shows the axonometric drawing of embodiment of the building block produced according to the manufacturing process of the invention, when it has already been filled with the post-hardening material 1, shown as transparent in the drawing, and is complete. In addition to the post-hardening material 1, the building block contains a static insert structure 2 assembled from flexible insert profiles 3, which has cutting edges 8. With the building block standing on its ground plane 10, positive adapters 12 are formed on the upper plane 11, while on the ground plane 10, negative adapters 13 are formed. On one of the faces of the building block, perpendicular to its flat front plane, grooves 14 designed for the lateral joining of the building blocks are formed, whereas on the other face, tongues 15 are formed, or the other way around. In case of an embodiment, six positive adapters 12 are shaped on the upper plane 11, whereas on the ground plane 10, also six negative adapters 13 are shaped, for which a static insert structure 2 assembled from five insert profiles 3 was proved to be the most appropriate.

Figure 9:
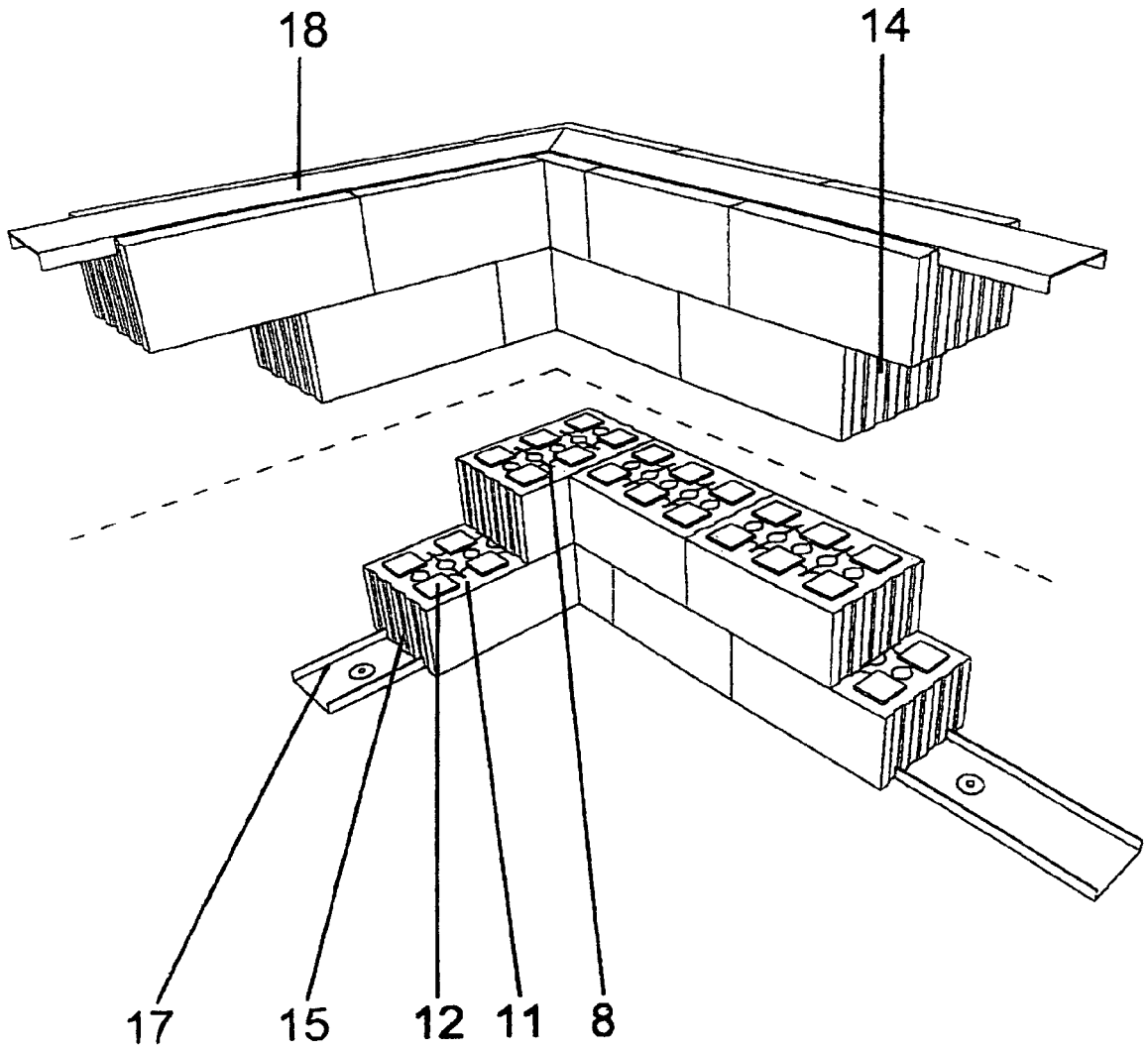
FIG. 9 shows the axonometric drawing of an embodiment of the building structure constructed with the use of the building block of the invention.

FIG. 9 shows the axonometric drawing of an embodiment of the building structure constructed with the use of the building block of the invention. For greater clarity, the figure shows the first two rows and the last two rows of the building structure between the lower blocking layer 17 and the upper blocking layer 18. (Intermediate rows of a similar structure are marked with a broken line.) The lower blocking layer 17 and the upper blocking layer 18 which are not the subject matter of the invention is a U-channel receptor, which fastened into the concrete base, and the last row is also closed with a profile turned down, on which beams are placed at particular distances. For the sake of stable fixing, the building blocks expediently overreach the U-channel on both sides, in the direction of their width. A row can be made in a way that the neighbouring elements are fitted to each other by their sides, in the longitudinal direction, in a way that the tongues 15 formed on one face of a building block is fitted into the grooves 14 formed on the other face of the other building block, or the other way around. Then the building blocks fitted to each other are stuck together and/or pressed together, and a row is built up this way, for example, the first row of the building structure. The building blocks of the next (second) row are placed on the building blocks of the first row, displaced in the longitudinal direction (for example, by one third of the length of the building block) in a way that the negative adapters 13 formed on the ground planes 10 of the building blocks, invisible in the drawing, are fitted on the positive adapters 12 formed on the upper plane 11 of the building blocks of the first row located thereunder so that the cutting edges formed on the ground planes 10 cut into the positive adapters 12 formed on the upper plane 11 of the building blocks of the first row thereunder. These steps are continued until the planned height of the building structure is built up, then the upper blocking layer 18 is fixed to the last row. If building blocks 61.5 cm long, 41 cm wide and 27 cm high are used, at the corner junction, the joint is created simply with two whole building blocks, with four pairs of adapters, with the help of the cutting edges 8, by means of joining the insert profiles 3 of the static insert structure 2, that is, one of the building blocks covers the other at any time and in any direction, and take its bearing on it on the whole surface, thus ensuring the even static distribution of the load. Consequently, at the corner junctions, the joint of the adapter pairs shall be four-four?, then two-four, two-four, and so on.

The making of the building block of the invention is carried out as follows, in consideration of the figures and the explanations thereof already set forth: By mixing a lightening material with a density less than 500 kg/m$^3$, cement and water, a post-hardening material 1 is produced. The building block is produced with the help of a form body 16 (template) in a way that a flexible static insert structure 2 made of metal is placed in the form body 16, then the form body 16 is filled up with the mixed post-hardening material 1. (If the mixed post-hardening material 1 is quite thin, it is poured into the form body 16 first, then the static insert structure 2 is place therein afterwards.)

If the static insert structure 2 has been embedded in the post-hardening material 1, the moist building block thus produced is let to dry in the form body 16 itself or after being taken out thereof until it is set. It is better to use a dense post-hardening material 1 mixed until it is earth-moist, because it can be poured into the form body 16 immediately, furthermore, setting time will be shorter.

The form body 16 is made to be suitable for the production of a prismatic building block.

The lightening material with a density less than 500 kg/m$^3$ is new, whole polystyrene foam balls with a diameter of 1-15 mm, or crushed or granulated polystyrene foam, or waste polystyrene foam, or perlite or chopped wood. In case of crushed or granulated polystyrene foam, the thermal conductivity value of post-hardening material 1 will be better. The post-hardening material 1 made from polystyrene foam, cement and water is a polystyrene foam concrete, which has the good features of all building materials, namely, it is of lightweight (its mass per unit volume is 350 kg/m$^3$, while that of the brick or the silicate is 800-1200 kg/m$^3$), furthermore with a thickness of 8 cm, it is fire resistant for 90 minutes.

The flexible static insert structure 2 is made of metal, expediently hot-dip galvanized steel 0.25-2 mm thick, which is assembled from at least one or more insert profiles 3 with the same structure. Depending on the length of the building block, the use of one, two, four or five insert profiles 3 is appropriate. With one piece, there is no need for an auxiliary tensioning element 7. The insert profiles 3 are joined with a permanent joint, such as spot welding, or with a detachable joint, such as bolts and nuts, thus they take over the static role in case of load, ensuring even load distribution.

For example, the building block produced from the post-hardening material 1 and the static insert structure 2 can be taken out of the form body 16 after being pressed together, and let it dry until set. Drying can be natural drying (28 days) or with the hot air drying it can take about 1 week. The accelerated drying of the building block can also be facilitated with the accelerator additive added to the post-hardening material 1. The following substances and approximately the following quantities thereof are necessary for the production of 1 m$^3$ of building block of the invention:

polystyrene foam 15 kg
cement (CEMI 32,5S quality) 280 kg
static insert structure made of metal 50 kg
crystal bound water (about 60 l water) 5 kg The application process implemented with the building block of the invention for the production of building structures has already been described in connection with FIG. 9, but it has to be emphasized that only a building block produced from the combination of two materials, namely the lightweight post-hardening material 1 and the flexible static insert structure 2, enables the construction of homogenous, solid, energy and weight efficient buildings, without a cold bridge, with high permeability and excellent fire retardant properties due to the identity of the thermal conductivity of the two materials and in consequence of the entire and even space filling of the post-hardening material 1 and the surrounding and retention of the static insert structure 2.

Buildings built up from the building block of the invention has a very good price/value rate, which is about 4,200 HUF/m$^2$, as opposed to that of buildings made of brick, which is 8,000 HUF/m$^2$, whereas that of buildings made of YTONG, it is 11,000 HUF/m$^2$, plus heat insulation.

For a 1 m$^2$ surface, 6 lightweight building blocks with dimensions of 61.5×41×27 cm, 24 kg each are required.

The building block of the invention has accomplished the aims of its manufacturing and application process and has the following advantages:

- it is energy and weight efficient (heat retaining, with a mass of 350 kg/m$^3$,
- horizontal effect and wind uplift resistant,
- its bearing capacity is 18 t/rm,
- it has excellent air and vapour permeability properties (vapour diffusion coefficient $\mu$=22),
- good thermal conductivity ($\lambda$=0.065 below passive house),
- good heat insulation properties (heat-transmission coefficient in case of a wall 41 cm thick U=0.17 W/m$^2$K)
- there is no need for traditional plastering, its internal and external wall surface can be coloured or covered with any material following technological gypsum plastering, it has good sound insulation properties, it is fire retardant, the wall structure does not burn just glow, its smoke generation coefficient is within the limit prescribed by the standard, it enables environmentally friendly, waste-free building, the waste of polystyrene foam concrete is reusable, it allows for simple and quick building (concrete about 30-40% less is necessary for groundwork, the building blocks can be fitted to each other easily), pipelines and wiring can be placed in the wall by milling with millimeter precision instead of slotting, mechanical systems can be built in with small-sized tools, building and construction can be continued until the temperature reaches −10° C., thus it can practically be used independently of the weather and the season, it can be economically produced; its production cost is about half, third of that of the known solutions.

The invention claimed is:

1. An energy and weight efficient building block, comprising:

a prismatic body comprised of a post-hardening material, the body having an upper face defining an upper plane and a bottom face defining a ground plane;

a flexible static insert structure comprising a plurality of interconnnected thin-walled elements embedded in the body and each of the plurality of interconnected thin-walled elements extending vertically between the upper plane and the lower plane and defining bottom edges adjacent the ground plane of the body, the plurality of interconnnected thin-walled elements providing static distribution of a cumulative load when stacked;

a plurality of positive adapters formed on the upper face and protruding from the upper plane of the body; and a plurality of negative adapters formed into the bottom face extending from the ground plane into the body, the negative adapters configured for being fitted on corresponding positive adapters of the building block located thereunder, the bottom edges of the flexible static insert structure exposed within each of the plurality of negative adapters and configured for engaging and fastening to one or more of the plurality of positive adapters of one or more building blocks located thereunder when a plurality of building blocks are stacked.

2. The building block of claim 1, wherein the flexible static insert structure is comprised of a plurality of insert profiles arranged in a row between two end faces of the prismatic body, each insert profile having a similar configuration and vertically oriented between the upper plane and the ground plane of the prismatic body.

3. The building block of claim 2, wherein each of the plurality of insert profiles are comprised of two mirror-symmetric half elements having a straight-line part extending from the lateral edges thereof and an arched-line part in a middle third thereof.

4. The building block of claim 3, further comprising a plurality of auxiliary tensioning elements connected between adjacent insert profiles proximate corresponding lateral edges of the adjacent insert profiles to both sides of the corresponding lateral edges, the bottom edges of the straight-line part and plurality of joining auxiliary tensioning elements forming cutting edges.

5. The building block of claim 4, further comprising perforations on surfaces of the two mirror-symmetric half elements and the auxiliary tensioning elements.

6. The building block of claim 1, wherein the static insert structure is comprised of metal.

7. The building block of claim 1, wherein the static insert structure is comprised of a plurality of cylindrical plastic tubes.

8. The building block of claim 1, wherein the flexible static insert structure is comprised of organic material.

9. The building block of claim 1, wherein the post-hardening material comprises polystyrene foam concrete.

10. The building block of claim 1, wherein when the body is standing on the ground plane, the plurality of positive adapters are formed on the upper plane, protruding from the upper plane thereof, each at approximately a same distance from a proximate edge of the upper plane, and the plurality of negative adapters are formed into the ground plane each at approximately the same distance from the proximate edge of the ground plane.

11. The building block of claim 1, wherein each of the plurality of positive adapters comprise one of a prism shape or a pyramid shape with a rectangular base, a cylindrical shape or cone shape.

12. The building block of claim 1, wherein the body further comprises a first face perpendicular to the upper plane having a first plurality of grooves and tongues alternately formed thereon and a second face opposite the first face having a second plurality of tongues and grooves alternately formed thereon, the first plurality of grooves and tongues of one building block configured to mate with the second plurality of grooves and tongues of another building block.

13. The building block of claim 1, wherein the flexible static insert structure provides even static distribution of a load applied to the body.

14. The building block of claim 13, wherein the flexible static insert structure is flexible for shape changes in a direction perpendicular to a direction of the load applied to the body.

15. An energy and weight efficient building block, comprising:

a body comprised of a post-hardening material, the body having an upper face defining an upper plane, a bottom face defining a ground plane, a first end face and a second end face on an opposite side thereof;

a flexible static insert structure embedded inside the body and integrally formed therewith, the static insert structure extending between the upper plane and the lower plane and defining bottom cutting edges adjacent the ground plane of the body, the flexible static insert structure comprised of a plurality of interconnnected thin-walled inserts, each of the plurality of inserts having a similar profile configuration and vertically oriented and extending between the upper plane and the ground plane of the body;

a plurality of positive adapters formed on the upper face and protruding from the upper plane of the body; and a plurality of negative adapters forming recesses into the bottom face of the body, the negative adapters shaped and sized to fit on corresponding positive adapters of a building block located thereunder, the bottom cutting edges of the flexible static insert structure exposed within each of the plurality of negative adapters and configured for engaging and fastening to one or more of the plurality of positive adapters of one or more building blocks located thereunder when a plurality of building blocks are placed on each other.

16. The building block of claim 15, further comprising a plurality of auxiliary tensioning elements connected between adjacent inserts proximate corresponding lateral edges of the adjacent inserts to both sides of the corresponding lateral edges, the bottom edges of the straight-line part and plurality of joining auxiliary tensioning elements forming the bottom cutting edges.

17. The building block of claim 16, wherein each of the plurality of inserts are comprised of two mirror-symmetric half elements having a straight-line part extending from the lateral edges thereof and an arched-line part in a middle third thereof.

18. The building block of claim 15, wherein the flexible static insert structure provides even static distribution of a load applied to the body.

19. The building block of claim 18, wherein the flexible static insert structure is flexible for shape changes in a direction perpendicular to a direction of the load applied to the body.

20. The building block of claim 16, wherein the plurality of inserts and the plurality of auxiliary tensioning elements each includes a plurality of perforations formed therein.

* * * * *